US005211571A

United States Patent [19]

Arai et al.

[11] Patent Number: 5,211,571

[45] Date of Patent: May 18, 1993

[54] SUBSTRATE CONNECTOR

[75] Inventors: Tatsuya Arai; Hiroshi Ohkawa; Hirokatsu Yaegashi; Morio Suzuki; Hiroshi Kouzai, all of Tokyo, Japan

[73] Assignees: Hirose Electric Co., Ltd.; Hitachi, Ltd., both of Tokyo, Japan

[21] Appl. No.: 655,859

[22] Filed: Feb. 15, 1991

[30] Foreign Application Priority Data

Feb. 23, 1990 [JP] Japan ..... 2-16762[U]
Sep. 6, 1990 [JP] Japan ..... 2-93121[U]

[51] Int. Cl.[5] ..... H01R 13/62

[52] U.S. Cl. ..... 439/325; 439/328; 439/630

[58] Field of Search ..... 439/325-328, 439/59-62, 629-637

[56] References Cited

U.S. PATENT DOCUMENTS

| | | | |
|---|---|---|---|
| Re. 32,559 | 12/1987 | Fedder et al. | 439/325 |
| 3,573,706 | 4/1971 | Haberlen | 439/328 |
| 4,781,612 | 11/1988 | Thrush | 439/62 |
| 4,826,447 | 5/1989 | Forker et al. | 439/328 |
| 4,850,891 | 7/1989 | Walkup et al. | 439/326 |
| 4,898,540 | 2/1990 | Saito | 439/326 |
| 4,917,624 | 4/1990 | Yu | 439/328 |

*Primary Examiner*—Larry I. Schwartz
*Assistant Examiner*—Hien D. Vu
*Attorney, Agent, or Firm*—Foley & Lardner

[57] ABSTRACT

A print substrate connector having a main body comprising a pair of supporting portions. A lock arm 26 is provided on a sidewall of a substrate mounting groove 22 formed in the main body of the substrate connector, into which groove 22 a terminal connecting portion 30 of the print substrate 29 is inserted. The part of the sidewall of the substrate mounting groove 22, on which part the lock arm 26 is placed, faces a vacant portion at the sides of the terminal connecting portion 30 of the print substrate 29, on which vacant portion no element is mounted. In operation or when the print substrate 29 is inserted into the mounting groove 22 of the main body, a locking claw 28 formed on the lock arm 26 is adapted to engage with a locking hole 32 formed on the vacant portion of the print conveniently used as a locking means of the substrate without a bad influence on a high density mounting of elements mounted on the substrate. A supporting foundation 34 of the lock arm 26 placed in parallel with the inner face of the sidewall of the connector main body 20*a* and has a forked end leaving a dent 35 on the bottom face of the forked end.

5 Claims, 8 Drawing Sheets

SUBSTRATE CONNECTOR

BACKGROUND OF THE INVENTION

1. Field of the Invention

The present invention relates to a connector for a small-size print substrate such as a memory module and the like and a print substrate connector of a cartridge type.

2. Description of the Prior Art

Generally a substrate connector shown in FIG. 14 consists of a housing 1 made by an injection molding dielectric material such as synthetic resin and the like, and contact pins (not shown) placed in the housing 1. The housing 1 has a groove 13 formed therein, into which groove is fitted an edge portion of the print substrate 7. It is noted that a locking means or mechanism for electrically connecting terminal connecting portion formed on the edge portion of the print substrate 7 to the contact pins is necessary.

According to a conventional locking structure or means for a substrate connector, supporting portions 2 formed at both ends of the housing 1 as shown in FIGS. 14–16 is formed by an endwall portion 3 and a sidewall portion 4. In addition, a protrusion 5 is formed at an inner free end of the endwall portion 3, a locking claw 6 is formed at an inner free end of the sidewall portion 4, and a locking hole 8 provided at both sides of the print substrate 7. When the print substrate 7 is installed or mounted on the substrate connector 1, the locking claw 6 is engaged with the locking hole 8.

An element mounting region (a), shown by hatching in FIG. 16, of the printed substrate 7 is the whole region excepting a terminal connecting portion 10 formed on both faces at the lower long edge of the printed substrate 7 generally in a manner parallel with the edge, a substrate insertion guide portion 11 contacting with the sidewall portion 4 of the supporting portion 2 placed at both ends of the substrate connector 1 when the printed substrate 7 is inserted into the connector 1, and a locking portion 12 having the locking hole 8.

However, according to the conventional structure of locking means of the substrate connector, locking portions 12 are placed on both sides of the printed substrate 7, on which sides elements are mounted, so that the element mountable spaces of the sides of the printed substrate 7 decrease by the element unmountable region b (a hatching portion). As a result, the element mounting region (a) of the printed substrate 7 decreases and a high density mounting is made impossible.

SUMMARY OF THE INVENTION

Therefore, it is the general purpose of the present invention to provide a novel and improved connector for substrates without such disadvantage as described above.

The purpose above is attained by a provision of the connector for substrates, which connector has its main body provided with a substrate insertion groove into which the terminal connecting portion of the printed substrate is inserted, and a lock arm having a locking claw, which arm is placed on the sidewall of the substrate insertion groove of the connector main body so as to face the vacant portion having no element mounted thereon. The locking claw is adapted to engage with a locking hole formed in the vacant portion placed on the side ends of the terminal connecting portion of the printed substrate.

When the terminal connecting portion of the printed substrate is inserted into the insertion groove in order to mount the printed substrate on the connector, and the locking claw fits in the locking hole in order to firmly lock the printed substrate, the vacant portion is used as a locking means for the substrate resulting in no influence on a high density mounting of elements.

According to the structure of the substrate connector of the present invention, lock arms are formed at both longitudinal ends of the insertion groove of the connector main body, into which groove the terminal connecting portion of the printed substrate is inserted, the lock arms have engagement protrusions adapted to be engaged with the locking holes formed in the printed substrate, and the lock arm has a forked supporting foundation placed in parallel with the sidewall of the connector main body. When the connector main body is inject-molded, resin flowing through the lock arm is identical with that through the entire structure of the connector without dead space for the flowing of material. In addition, the lock arm has a symmetrical shape when viewed from its front face and side faces, so that substantially no size-change is apparent even though the connector shrinks after molding.

According to the present invention, a substrate connector is described wherein, an indentation is formed on the bottom face of the supporting foundation of the lock arm, thereby detergent or liquid cleaner between the lock arm and a sidewall of the connector main body is evacuated out of the connector through the indentation.

Accordingly, it is a purpose of the present invention to provide a substrate connector solving a shortcoming of restricting the element mountable region or space of printed substrate according to the prior art, which connector is suitable to mount elements at a high density.

It is another purpose of the present invention to provide a substrate connector, in which connector the resin flow during a molding process is smoothly controlled and there are no substantial changes in the size of the connector even though the structure shrinks after its molding, resulting in obtaining of a stable locking force of the substrate.

It is another purpose of the present invention to provide a substrate connector that prevents liquid cleaner from staying on the body of the substrate connector.

Other purposes and advantages of the present invention will be further explained in the following description with reference to the accompanying drawings, wherein.

DESCRIPTION OF THE PREFERRED EMBODIMENTS

Figure 1:
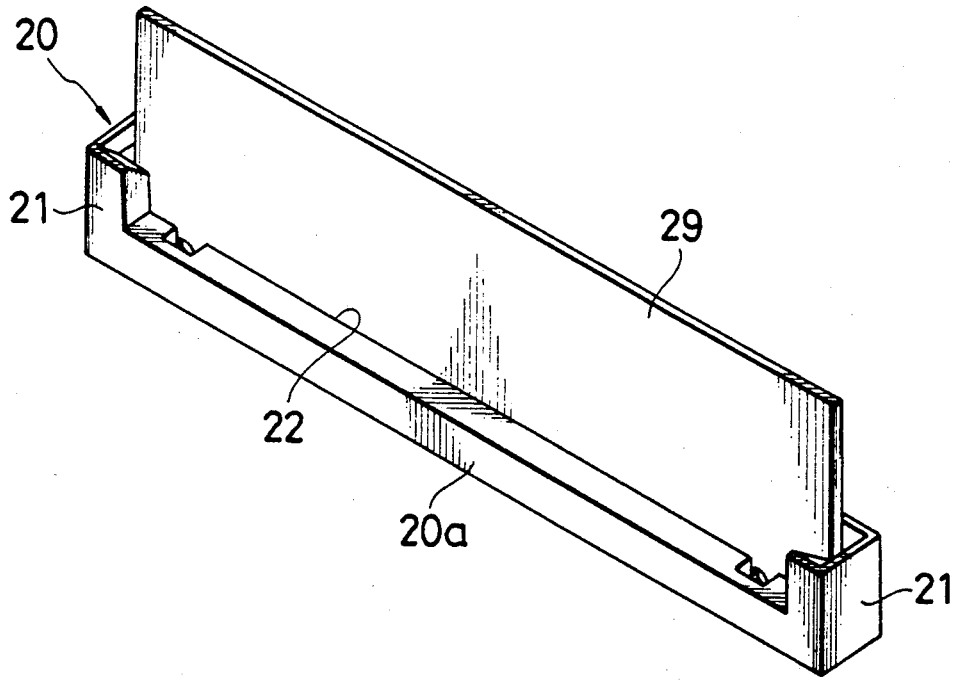
FIG. 1 is a perspective view of a substrate connector according to the present invention having a printed substrate mounted thereon.

Referring now to the drawings, wherein the same reference numerals designate like or corresponding parts throughout the several views, several embodiments of the present invention will be described.

Figure 3:
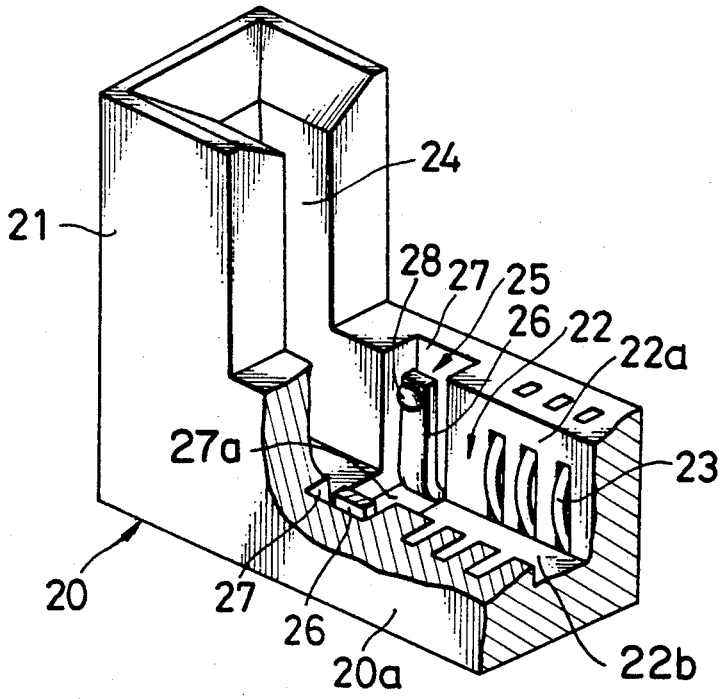
FIG. 3 is a partially cutaway view in perspective of a preferred first embodiment of the locking means of the printed substrate connector.

As shown in FIG. 1 depicting the first preferred embodiment of the present invention, the substrate connector 20 according to the first embodiment consists of a main body 20*a*, which main body 20*a* is provided with a couple of substrate supporting portions 21 formed at both ends of the connector main body 20*a*. The connector main body 20*a* has a substrate insertion groove 22 formed in the main body 20*a* so as to extend in parallel with the longitudinal direction of the main body 20*a*. A number of contacting terminals 23 are formed on the inner faces of the sidewalls 22*a* of the insertion grooves 22 as shown in FIG. 3 depicting the lock structure of the first embodiment of the present invention. It is noted that the supporting portion 21 has a substrate insertion guide groove 24 formed therein so as to communicate, through its bottom, with the substrate insertion groove 22. A lock mechanism 25 is provided on both sides of the substrate insertion groove 22. The lock mechanism 25 is provided with a pair of lock arms 26, as shown in FIG. 3, formed integrally with the connector main body 20*a*. These lock arms 26 are placed in lock arm containing grooves 27 so as to move individually and independently in the front-and-rear and left-and-right directions with respect to the inner face of the sidewall 22*a* of the substrate insertion groove 22, and to face to each other sandwiching the substrate insertion groove 22. Locking claws 28 shaped in a hemisphere are formed so as to protrude from the inner surfaces of the end portions of the lock arms 26. It is noted that the locking claws 28 protrude from the inner face of the sidewall 22*a* of the insertion groove 22.

Figure 2:
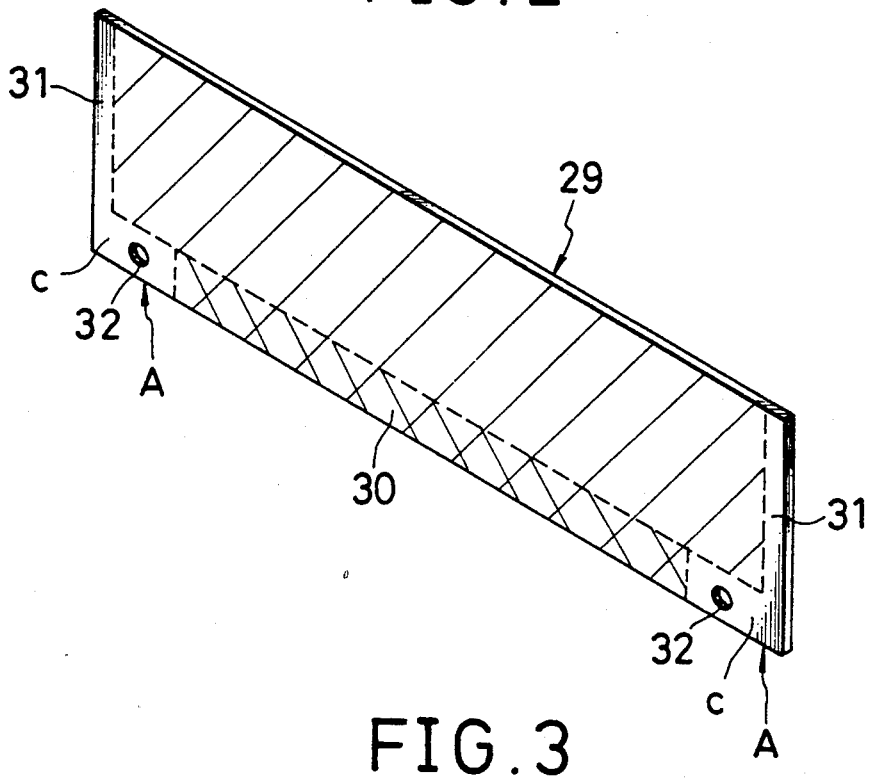
FIG. 2 is a perspective view of the printed substrate.

It is apparent from FIG. 2 that the printed substrate 29 has a pair of terminal connecting portions 30 formed on both faces of a longitudinal edge of the printed substrate 29 in parallel to each other, and a pair of insertion portions 31 to be inserted through the substrate insertion guide groove 24 of the supporting portions 21 formed at both ends of the substrate connector 20. In addition, the printed substrate 29 has a pair of locking holes 32, respectively placed in vacant portions c formed at both ends of the terminal connecting portions 30, on which vacant portions c no element is mounted.

Consequently, when the terminal connecting portions 30 are inserted into the substrate insertion groove 22 and the printed substrate 29 is mounted to the substrate connector 20, the locking claws 28 fit to the locking holes 32 completing locking of the printed substrate. 29. A width of the terminal connecting portion 30 provided on the printed substrate 29 is narrower than the whole width of the printed substrate 29, which whole width being determined by sizes of the region in which region elements being mounted. The print substrate as a pair of locking holes 32 as shown in FIG. 2. The holes are formed in the vacant portions c of the substrate 29. No element is mounted on the vacant portions c, which are placed at both ends or sides of the substrate 29 as seen in FIG. 2.

The locking holes 32 are used to lock the substrate when the substrate is inserted in the substrate connector 20 and a pair of lock arms 26 enter in the holes 32. The area of the vacant portions C is very small, so that there is absolutely no inconvenience or a bad influence on a high density mounting rate or the total number of elements mounted upon the substrate.

Further, as shown in FIG. 3, the substrate mounting groove 22 of the connector 20 has a pair of the lock arm containing grooves 27, which are formed in the left and the right elevation sidewalls 22*a* of the substrate mounting groove 22. It is noted that the substrate mounting groove 22 has a part of bottom portion 27*a* lower with a step than the main bottom face 22*b* of the groove 22. The lock arms 26 stand on the bottom portion 27*a* and are placed within the lock arm containing grooves 27.

Figure 4:
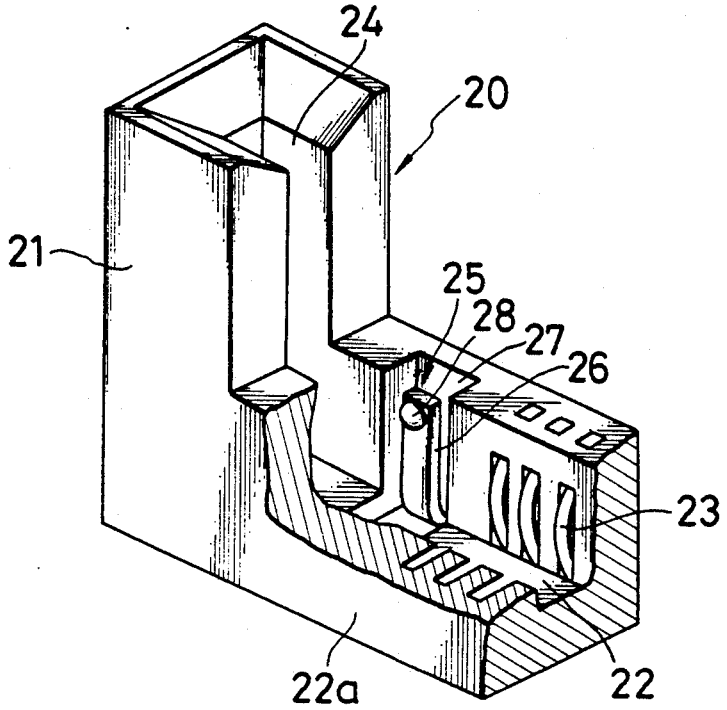
FIG. 4 is a view similar to FIG. 3 of the locking means according to another embodiment of the present invention.

According to another embodiment of the lock mechanism 25 shown in FIG. 4, although one of the first embodiment as shown in FIG. 3 has pairs of lock arms 26 and locking claw 28, respectively situated sandwiching the substrate insertion groove 22, a lock arm 26 and a locking claw 28 are situated at one side of a single inner face of the sidewall 22*a* of the supporting portion 21.

Figure 5:
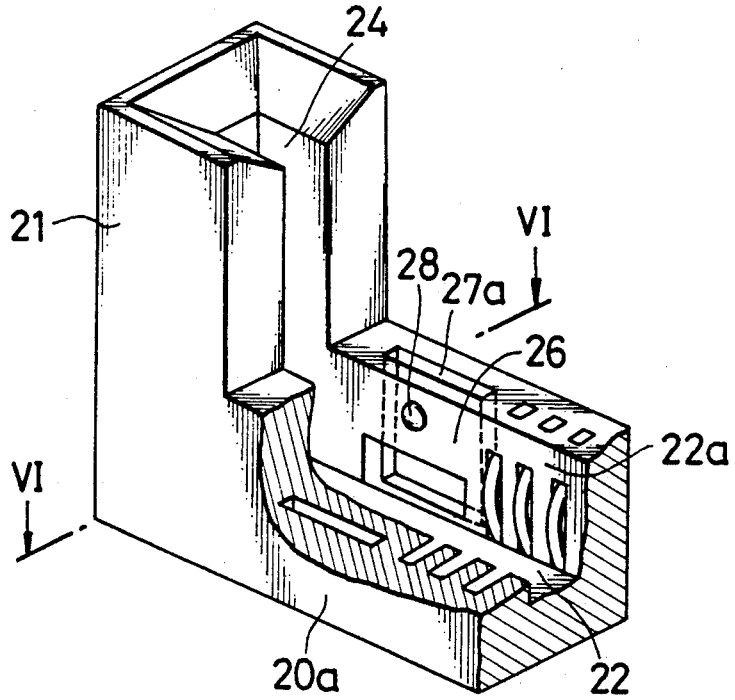
FIG. 5 is a view similar to FIG. 3 of another embodiment.
Figure 6:
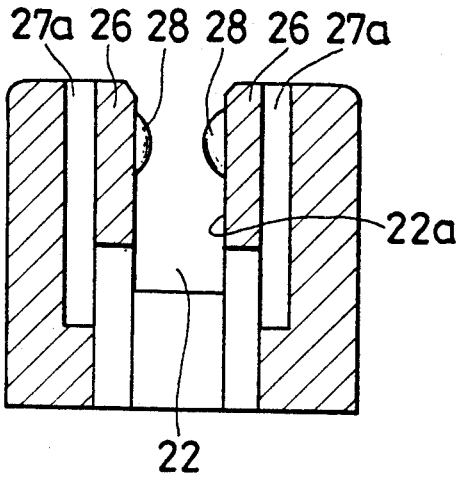
FIG. 6 is a section taken along line VI—VI in FIG. 5.

FIG. 5 shows another embodiment of the lock mechanism 25, in which embodiment a pair of lock arms 26 is formed so as to sandwich the substrate insertion groove 22 integrally with the connector main body 20*a*. A pair of grooves or spaces 27*a* are formed back of the lock arms 26 and both sides of the lock arm 26 join to the sidewall 22*a*, so that lock arms 26 moves independently of the sidewall 22*a* of the substrate insertion groove 22. In addition, a hemispherical locking claw 28 is formed at the central portion of an inner face of the lock arm 26.

As a result, it is possible to lock firmly the printed substrate 29 when the terminal connecting portion 30 of the printed substrate 29 is inserted into the substrate insertion groove 22 in order to mount the printed substrate 29 on the substrate connector 20, and the locking claw 28 fits in the locking hole 32.

Additionally, the lock arm 26 is connected to the sidewall 22*a* of the substrate insertion groove 22 through sides of the arm, however it may be connected to the sidewall through its single side.

Figure 7:
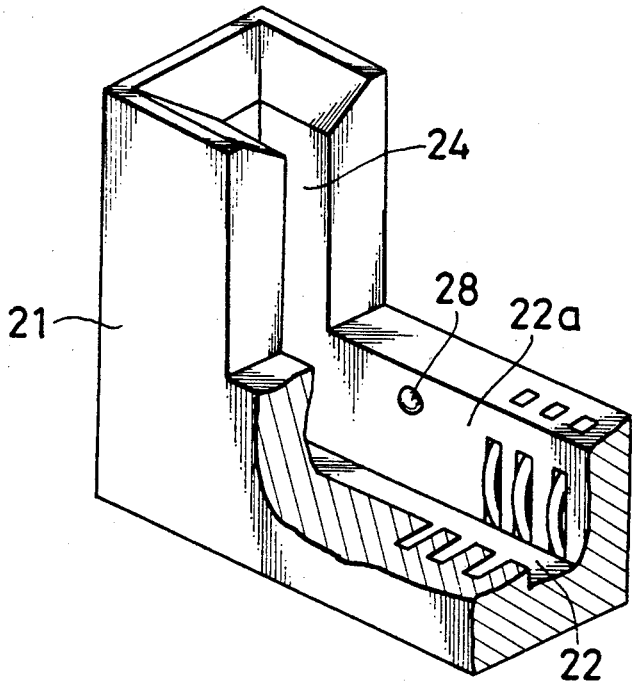
FIG. 7 is a view similar to FIG. 3 of the locking means of another preferred embodiment.

FIG. 7 depicts the fourth embodiment of the lock mechanism 25, which doesn't have any lock arm and consequently a locking claw 28 is formed directly on the inner face of the sidewall 22*a* of t he substrate insertion groove 22.

As a result, when the printed substrate 29 is mounted on the substrate connector 20 by inserting the terminal connecting portion 30 of the substrate into the insertion groove 22, the locking claw 28 fits in the locking hole 32 resulting in a firm locking of the printed substrate 29.

Figure 8:
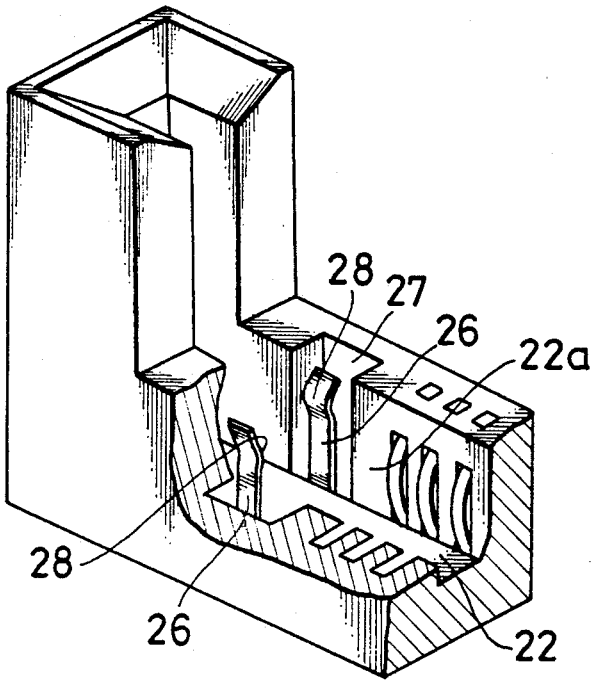
FIG. 8 is also a view similar to FIG. 3 of the locking means of another preferred embodiment.

The fifth embodiment of the lock mechanism 25 is apparently shown in FIG. 8. According to the embodiment, the lock arm 26 and the locking claw 28 of the lock mechanism 25 are formed integrally of, for example, spring metal. In detail, the lock arm 26 bent at its end to form a locking claw 28 is contained in a lock arm containing groove 27 formed in the inner face of the sidewall 22*a* of the substrate insertion groove 22, and a base portion of the lock arm 26 is secured to the bottom of the lock arm containing groove 27.

Subsequently, when a printed substrate 29 is mounted on the substrate connector 20 after inserting the terminal connecting portion 30 into the substrate insertion groove 22, the locking claw 28 formed at the end of the lock arm 26 fit in the locking hole 32, resulting in a firm locking of the printed substrate 29.

As described above with reference to various embodiment of the present invention, a locking claw 28 is provided on the part of an inner face of the sidewall 22*a* of the substrate insertion groove 22 formed in the connector main body 20*a*, into which groove the terminal connecting portion 30 of the printed substrate 29 being inserted, and to which part of the inner face the vacant portion c placed at ends of the terminal connecting portion 30 of the printed substrate 29 facing, and let the locking claw 28 fits in the locking hole 32 formed in the vacant portion c of the printed substrate 29. It is said that the vacant portion c can be used for a locking purpose of the printed substrate 29. Due to the fact above, inconvenience that the element mountable space of the printed substrate 29 being narrowed is solved and the printed substrate 29 becomes of suitable to mount elements in high density or integrity.

Figure 9:
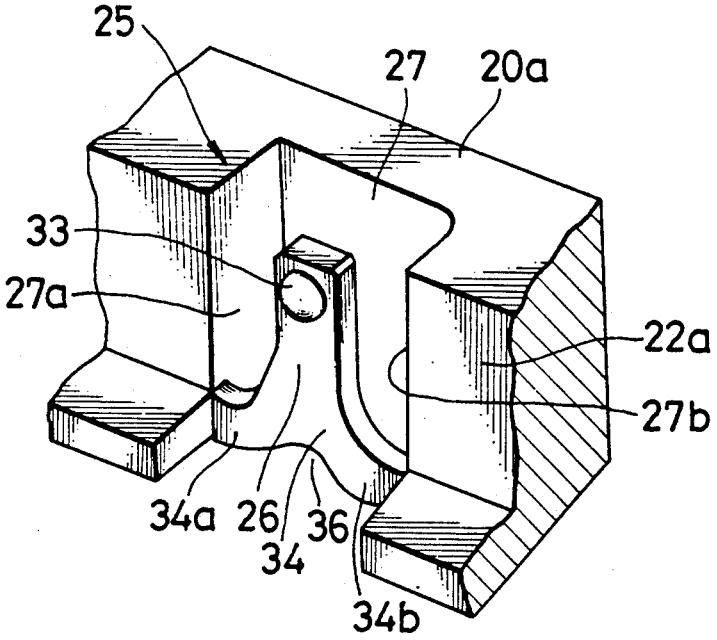
FIG. 9 is a partially cutaway view in perspective of another embodiment of the locking means.

The sixth embodiment of the lock mechanism 25 according to the present invention is shown in FIG. 9. According to the embodiment, the lock arm containing groove 27 formed in the sidewall 22*a* of the substrate insertion groove 22 extends vertically and a locking claw 28 is placed in the lock arm containing groove or space 27.

The lock arm 26 is placed or directed in parallel with the inner face of the sidewall 22*a* of the substrate insertion groove 22 and a foundation of the lock arm 26 is used as a supporting portion 34. The supporting portion 34 has a forked base end consisting of a supporting foot or beam 34*a* connected to one of the inner faces of the lock arm containing groove 27 and another supporting foot 34*b* connected to another one of the lock arm containing groove 27. The supporting portion 34 extends substantially along the longitudinal direction of the connector main body 20*a*.

The shape of the lock arm 26 having the supporting portion 34 is symmetrical when seeing the front and the sides of the lock arm 26.

Figure 10:
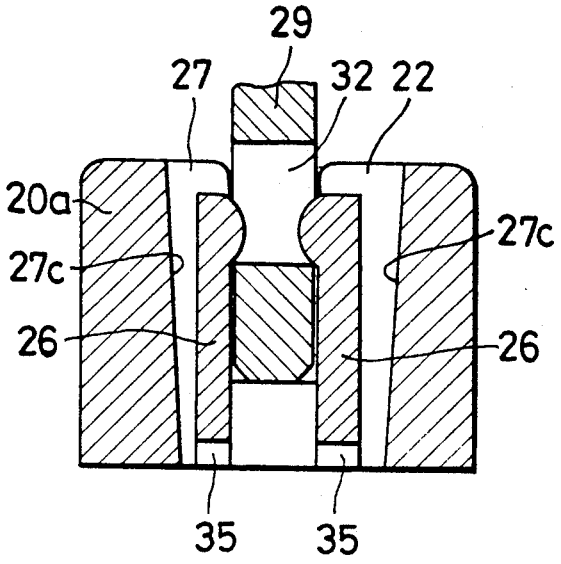
FIG. 10 is a section showing a printed substrate locked to the connector provided with the locking means shown in FIG. 9.
Figure 11:
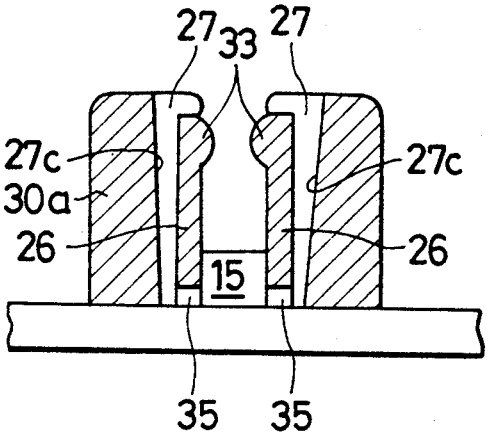
FIG. 11 shows a sectional view depicting the effect of the lock arm of the locking means shown in FIG. 9.
Figure 12:
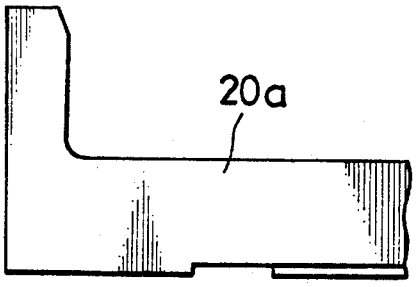
FIG. 12 is a side, elevational view of the end of the housing.

When engagement projections 33 of the pair of lock arms 26 are engaged with locking holes 32 formed in the printed substrate 29 as shown in FIG. 10, the printed substrate 29 is firmly locked to the substrate connector 20.

In consequence, as described above, the foundation of the lock arm 26 is formed in a shape of a supporting portion 34, the supporting portion 34 has one forked end provided with a supporting foot 34*a* which is connected to the inner face 27*a* of the sidewall 22*a*, and another forked end provided with another supporting foot 34*b* which is connected to the inner face 27*b* of the sidewall 22*a*, and the supporting protion 34 extends substantially in parallel with a longitudinal direction of the connector main body 20*a*, so that a flowing direction of plastic resin material, in an inject molding of the connector main body 20*a*, through the lock arm 26 and the supporting portion 34 is identical with the longitudinal direction of the whole structure of the connector, and additionally there is no dead space of the plastic flowing.

As a result, a space of the mold for, in particular, the supporting portion 34 is surely filled with the material and a strength of the supporting portion 34 is certainly obtained. Again, the supporting portion 34 provided with a forked end consisting of two supporting feet 34*a* and 34*b* is symmetrical in shape seeing in its front and its sides directions, so that no influence of a shrinkage of material after molding to the symmetrical shape of the supporting portion 34 and there is substantially no change in size of the supporting portion 34 having the forked end, resulting in preferably a stable locking force or efficiency of the substrate.

In addition, it is apparent from FIG. 10 that there is a dent 35 on a lower face of the lock arm 26 and there is a space or gap between a rear face of the lock arm 26 and an inner face 27*c* of the lock arm containing groove 27.

Figure 13:
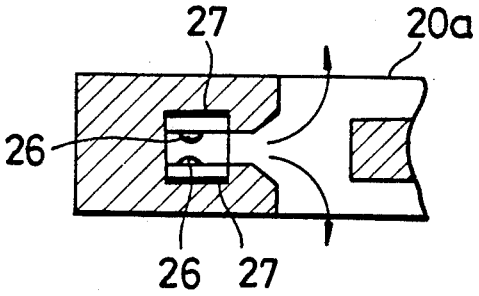
FIG. 13 is a bottom view of the housing.
Figure 14:
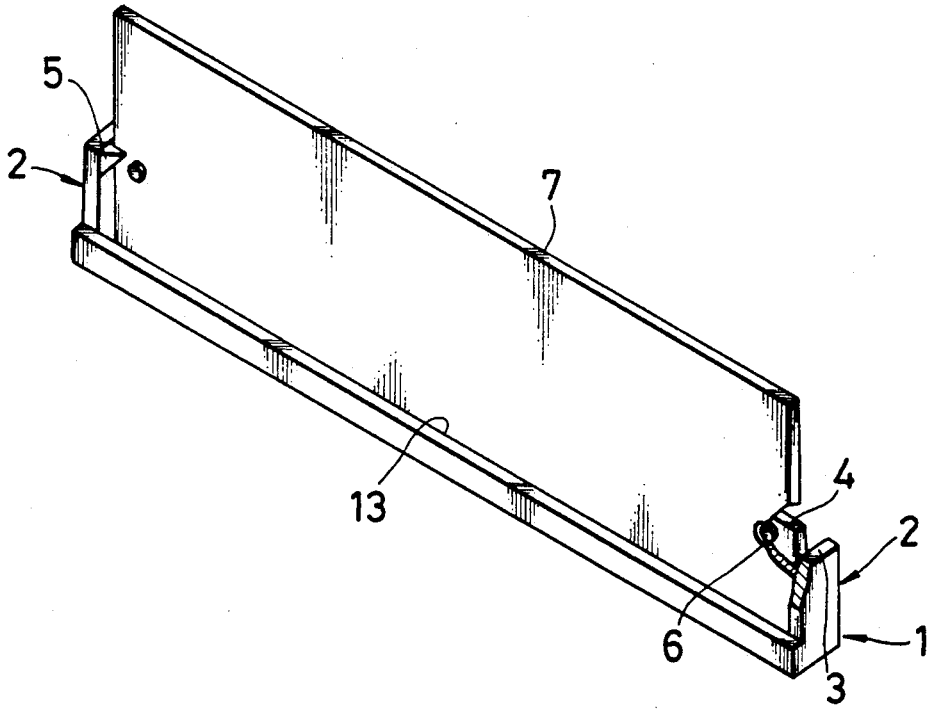
FIG. 14 PRIOR ART
FIG. 14 is a perspective view of the conventional substrate connector and a printed substrate mounted thereon.
Figure 15:
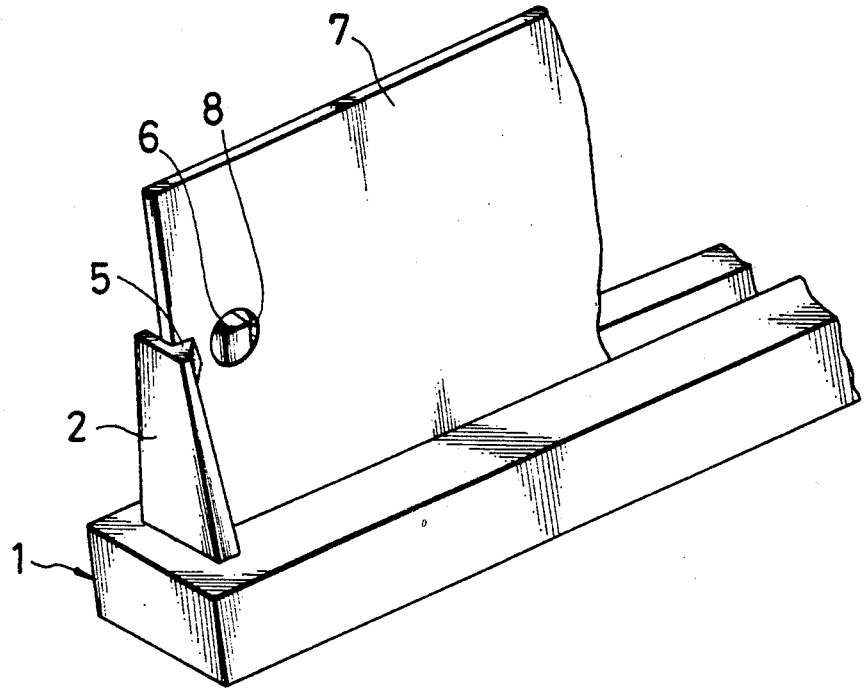
FIG. 15 PRIOR ART
FIG. 15 is a partial cutaway view in perspective of the connector and the printed substrate according to the prior art.
Figure 16:
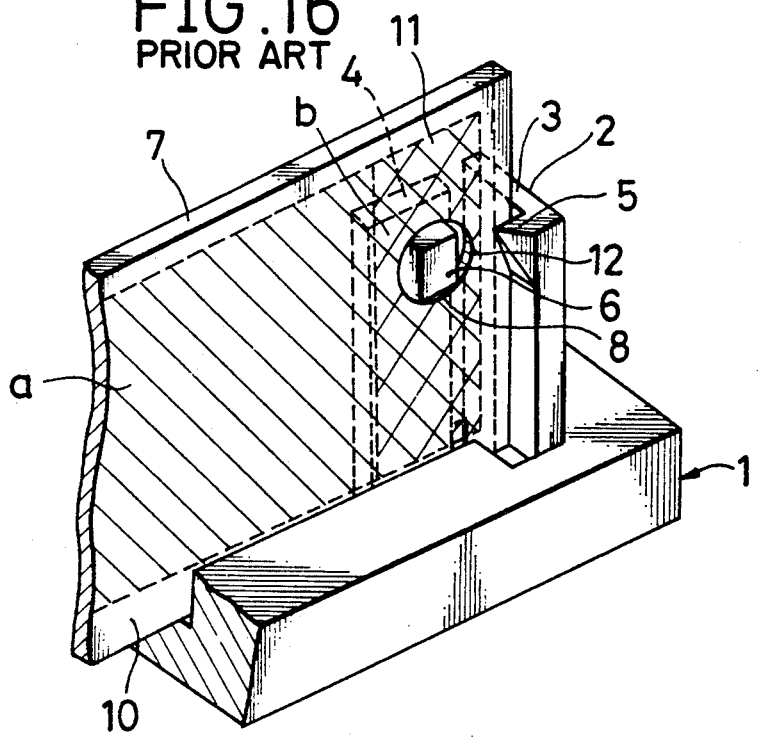
FIG. 16 PRIOR ART
FIG. 16 is a detailed view of FIG. 15.

As shown in FIG. 13 depicting a hatched portion of a contact between the printed substrate 29 and the connector main body 20*a*, cleaning liquid is flown along the directions of arrows shown, after flowing-down through the lock arm containing groove 27, through the indentation formed under the lock arm 26. In consequence, during cleaning of the substrate connector 20, cleaning liquid or detergent accumulated between the lock arm 26 and the connector main body 20*a* can be evacuated and flown out of the connector main body 20*a* through the indentation 35.

As described above, according to the structure of the substrate connector, the locking claw is provided on the inner face of the sidewall of the substrate mounting groove of the connector main body, into which groove the terminal connecting portion of the printed substrate is inserted and to which inner face the vacant portion having no element mounted at these sides of the terminal connecting portion of the printed substrate, and the locking claw is adapted to fit in the locking hole formed on the vacant portions formed at these sides ends of the terminal connecting portion. Consequently, when the printed substrate is mounted on the substrate connector, the locking claw fits in the locking hole resulting in a firm locking of the printed substrate.

The width of the terminal connecting portion of the printed substrate is narrower than the whole width of the printed substrate, which whole width being determined by the size of the region having elements mounted, the vacant portion at the sides of the terminal connecting portion of the substrate, which vacant portion having no elements mounted thereon has a locking hole and this locking hole is used as a locking means. As a result, the vacant portion fails to influence a high density mounting of elements on the printed substrate.

According to another structure of the substrate connector of the present invention, a lock arm provided with an engagement projection adapted to be engaged with or to fit into the locking hole formed in the printed substrate is formed near both ends longitudinally of the substrate insertion groove of the substrate connector into which groove the terminal connecting portion of the printed substrate is inserted, and also the forked supporting foundation of the lock arm is placed in parallel with the inner face of the sidewall of the substrate connector, so that the flowing direction of plastic resin material in the lock arm mold is made identical with the flowing direction of plastic resin material in the whole mold of the connector and also there is no dead space for the flowing in the process of an injection molding of the substrate connector, thereby preventing the mold of the lock arm from being incompletely filled. In addition, it is possible to attain substantial and sufficient strength of the resultant lock arm and locking claw, and there is no deviation and distribution in size of the lock arm and locking claw because there is no shrinkage of the material after being cooled, resulting in a stable locking force for the substrate connector.

According to the structure of the substrate connector of the present invention, an indentation for evacuating detergent or liquid cleaner is formed on the bottom face of the lock arm in order to discharge, through the indentation, the liquid cleaner trapped in the space between the lock arm and the connector main body's inner wall out of the substrate connector, so that the detergent is effectively prevented from being trapped in the connector main body.

While some preferred embodiments of the present invention have been shown and described, it will be understood that it is not to be limited to all of the details shown, but is capable of modification and variation within the spirit of the invention and within the scope of the following claims.

What is claimed is:

1. A lock mechanism of a printed substrate connector provided with locking holes, comprising a main body of the connector having an insertion groove in which a terminal connecting portion of the printed substrate is inserted, wherein said insertion groove has a sidewall provided with a pair of lock arms each having a locking claw adapted to be engaged with said locking hole when the terminal connecting portion of the printed substrate is inserted into the insertion groove formed in the connector main body, the locking holes of the printed substrate being placed in right and left vacant portions of the terminal connecting portion, lock arm containing grooves being formed on the right and the left sides of the insertion groove of the connector main body so as to have bottoms lower than the bottom of the insertion groove, said pair of lock arms being made of a resilient material and integral one-piece, with the connector main body, said pair of lock arms being placed at symmetrical positions of the center of the insertion groove and placed in the lock arm containing grooves and extend upwardly from the bottoms of the lock arm containing grooves, said lock arm having a locking claw adapted to engage with the locking hole of the printed substrate, the distance of a gap between the pair of opposed locking claws of lock arms being smaller than the thickness of the printed substrate inserted in the gap, said gap being expanded due to elasticity of the lock arms when the printed substrate is being inserted into the gap, said gap returning to almost the original position due to elasticity of the lock arms when the locking claw is being placed in the locking hole in order to lock the locking claw to the locking hole.

2. A lock mechanism of a printed substrate connector provided with locking holes, comprising a main body of the connector having an insertion groove in which a terminal connecting portion of the printed substrate is inserted, wherein said insertion groove has a sidewall provided with a pair of lock arms each having a locking claw adapted to be engaged with said locking hole when the terminal connecting portion of the printed substrate is inserted into the insertion groove formed in the connector main body, the lock arms being integrally formed in one piece with the connector main body and being shaped in a left and right symmetrical looking from its front and sides, the lock arms having their supporting portions on their base portions, the supporting portions being of a fork shape, one end of the fork being connected to a side wall portion of said lock arm containing groove and another end of the fork being connected to another side wall portion of said lock arm containing groove, and the supporting portions of a fork-shape being placed almost in parallel with the longitudinal direction of the connector main body.

3. A printed substrate connector according to claim 2, wherein the forked end of said locking arm comprises legs which form a substantially Y-shape.

4. A lock mechanism of a printed substrate connector provided with locking holes, comprising a main body of the connector having an insertion groove in which a terminal connecting portion of the printed substrate is inserted, wherein said insertion groove has a locking claw adapted to be engaged with said locking hole when the terminal connecting portion of the printed substrate is inserted into the insertion groove formed in the connector main body, lock arm containing grooves being formed in the opposed sidewalls of the insertion groove of the connector main body, lock arms being integrally formed in one-piece with the connector main body, and being installed in the lock arm containing groove leaving a space between the lock arms and the lock arm containing groove faces, the lock arms having indentations communicated with the outside of the connector main body, said indentations being placed at the lower faces of the lock arms, and the substrate contacting face of the connector main body having a shape so shaped as to make detergent or washing water flow through the lock arms and the lock arm containing groove faces indentations.

5. The lock mechanism for a printed substrate connector according to claim 4, wherein the supporting portions of the lock arms comprise legs which form a substantially Y-shape.

* * * * *